US008376248B2

(12) United States Patent
Meisner et al.

(10) Patent No.: US 8,376,248 B2
(45) Date of Patent: Feb. 19, 2013

(54) FAUCET HAVING PULL-OUT SPRAY HANDLE

(75) Inventors: David J. Meisner, Monmouth Beach, NJ (US); Walter Pitsch, Washington, NJ (US); Jianglin Yan, Jimei (CN)

(73) Assignee: AS IP Holdco, L.L.C., Piscataway, NJ (US)

( * ) Notice: Subject to any disclaimer, the term of this patent is extended or adjusted under 35 U.S.C. 154(b) by 290 days.

(21) Appl. No.: 12/277,601

(22) Filed: Nov. 25, 2008

(65) Prior Publication Data

US 2010/0125946 A1 May 27, 2010

(51) Int. Cl.
*B05B 9/08* (2006.01)

(52) U.S. Cl. ..... 239/530; 239/280; 239/281; 239/525; 239/587.1; 239/588; 239/600; 239/443; 285/302

(58) Field of Classification Search ..... 239/447, 239/451, 453, 456, 530, 280, 281, 525, 587.1, 239/588, 443; 137/801; 285/302
See application file for complete search history.

(56) References Cited

U.S. PATENT DOCUMENTS

| | | | | |
|---|---|---|---|---|
| 4,609,006 | A | 9/1986 | Parkison et al. | |
| 5,158,234 | A * | 10/1992 | Magnenat et al. | 239/449 |
| 5,349,987 | A * | 9/1994 | Shieh | 137/801 |
| 5,499,767 | A * | 3/1996 | Morand | 239/383 |
| 5,758,690 | A * | 6/1998 | Humpert et al. | 137/801 |
| 6,085,790 | A * | 7/2000 | Humpert et al. | 137/801 |
| 6,126,290 | A * | 10/2000 | Veigel | 362/96 |
| 6,202,686 | B1 | 3/2001 | Pitsch et al. | |
| 6,978,795 | B2 | 12/2005 | Perrin | |
| 7,216,820 | B2 | 5/2007 | Nelson et al. | |
| 2004/0226088 | A1 | 11/2004 | Ouyoung | |

OTHER PUBLICATIONS www.americanstandard.com; Product Detail; Culinaire™ Pullout Kitchen Faucet; pp. 1-2; model specifications; pp. A1-A2. At least prior to Nov. 25, 2008.
www.americanstandard.com; Product Detail; Culinaire Hi-Flow Pull-Out Kitchen Faucet; pp. 1-2; model specifications; pp. A7-A8. At least prior to Nov. 25, 2008
www.americanstandard.com; Product Detail; Lakeland Pull Out Kitchen Faucet; pp. 1-2; model specifications; pp. A11-A12. At least prior to Nov. 25, 2008.
www.americanstandard.com; Product Detail; Pekoe Pull-Out Kitchen Faucet; pp. 1-2; pp. 1-2; model specifications; pp. A13-A14. At least prior to Nov. 25, 2008

(Continued)

*Primary Examiner* — Dinh Q Nguyen
(74) *Attorney, Agent, or Firm* — Flaster/Greenberg PC

(57) ABSTRACT

The disclosure provides faucets, faucet assemblies and methods for delivering liquid through a faucet. The faucet includes a faucet body having a first open end configured for connection with a faucet base, a second open end for receiving a faucet handle, and a faucet body portion having an opening therein. The faucet body has an inner wall defining a passage extending therethrough. The faucet also includes a faucet handle and a spray handle having a first end section and a sprayer end section. The first end section is configured to be detachably connected to the faucet body portion, and the spray handle has an inner wall and a passage extending therethrough which is in open communication with the passage through the faucet body. The faucet also has a hose connection that can receive a hose for delivering liquid to the spray handle. The hose connection may be in the sprayer end section of the spray handle. The faucet may also include a mechanism for liquid flow control and/or a pull-down diverter in liquid communication with the hose connection for aerated or spray flow.

37 Claims, 7 Drawing Sheets

OTHER PUBLICATIONS www.americanstandard.com; Product Detail; Arch Pull-Out Kitchen Faucet; pp. 1-2; model specifications; pp. A21-A22. At least prior to Nov. 25, 2008.

www.americanstandard.com; Product Detail; Reliant+ Kitchen Combi Faucet; pp. 1-2; pp. 1-2; model specifications; pp. A25-A26. At least prior to Nov. 25, 2008

* cited by examiner

FAUCET HAVING PULL-OUT SPRAY HANDLE

BACKGROUND OF THE INVENTION

1. Field of the Invention

The invention is related to faucets including pull out sprayers for spraying a wide area at angles, particularly with respect to such pull-out spraying faucets that are used for kitchen sink use.

2. Description of Related Art

It is known in the art to use diverter valves and mechanisms to switch a faucet sprayer from regular, aerated water flow to a spray-head spray. Such diverters come in various configurations including a pull-down diverter mechanism, wherein the user pulls downward on the diverter mechanism at the end of a faucet to create a spray or "shower" effect.

Kitchen faucets typically have a direct aerated water flow. Water enters kitchen faucets through a copper inlet tube or flexible hose, which generally has a metallic connector linking into the body of the faucet for delivering water flow to the portion of the faucet body having the faucet outlet. In some cases, the water outlet hose from the hot and cold mixer is split below the body and base plate of the faucet to provide a divided and separate hose and direction of flow, generally including a diverter mechanism to allow a side stream of water to enter a hand-held sprayer mechanism separate and apart from the faucet body. Many such hand-held sprayers are located on one side of the faucet assembly with a separate opening in the sink base outside of the faucet base plate. When the handle of the hand-held sprayer is actuated, it operates a diverter mechanism that diverts flow from the portion of the hose directing water to the faucet body to the hand-held sprayer portion and away from the direct faucet stream.

More recently, an improvement was developed to avoid use of significant additional parts below the surface of the sink or use of a divided and separate hose section, by making the faucet body itself capable of performing the spray function as well by virtue of a multi-part combination spray-head and faucet assembly, wherein a sprayer handle portion of the faucet is detachable from the body of the faucet. This allows for a hand-held sprayer portion to detach from the faucet body and be separated therefrom by a flexible hose that runs through the faucet body and attaches at the faucet-facing end of the hand-held sprayer portion. The hose is typically connected via a reinforced metallic coupling nut/threaded connection to the rear (or faucet-body facing end) of the detachable hand held sprayer. Thus, when the hand-held sprayer portion is pulled outwardly from the faucet, the hose pulls up through and out of the faucet body with the sprayer, and water then flows through the faucet body within the extended hose and coupling nut connection into the hand-held sprayer and outwardly through a reinforced interior of the hand-held sprayer to a diverter mechanism, if any. Use of such diverters for switching from a shower spray to a direct aerated spray are generally operated by push button mechanisms located on the top portion of the hand-held sprayer, by a diverter switch or diverter handle.

Such faucets, while useful over prior art faucets having wholly separate spray functions, so as to become multifunctional and compact regarding the space required for use, still typically require many working parts, and have reasonably high manufacturing costs for forming a reinforced hand-held sprayer portion as well as for preparing various required metallic connectors and internal pieces. In addition, many of the push-button and switch mechanisms for existing hand-held sprayers fail over time and/or do not work smoothly. In many cases, they are positioned, such that while the user is holding the nozzle head, it is easy to put pressure inadvertently on the diverter actuator and shut off the shower sprayer while in use.

Accordingly, there is a need in the art for improved combination faucet assemblies that provide diverse features using less space, particularly for kitchen faucets, while providing a compact, detachable configuration and hand-held sprayer, and easy actuation of the shower spray to aeration diverter function, but which are also inexpensive to manufacture and are also durable and reliable.

BRIEF SUMMARY OF THE INVENTION

The invention includes a faucet comprising, a faucet body having a first opening configured for connection with a faucet base, a second opening, and a faucet body portion having an opening therein, wherein the faucet body has an inner wall defining a passage extending therethrough; a mechanism to control liquid flow through the faucet body; and a spray handle having a first end section and a sprayer end section, wherein the first end section is configured to be detachably connected to the faucet body portion, an inner wall defining a passage extending therethrough in open communication with the passage extending through the faucet body, and a hose connection is positioned within the spray end section of the spray handle, the hose connection being configured for receiving a hose extending through the spray handle. In one embodiment, the faucet described herein is a kitchen faucet.

In a further embodiment, the faucet herein further includes a spray handle having a pull-down diverter in liquid communication with the hose connection in the spray end section of the spray handle, the diverter being capable of providing a first spray mode and a second spray mode.

The invention further includes a faucet comprising: a faucet body having a first open end configured for connection with a faucet base, a second open end, and a faucet body portion having an opening therein, wherein the faucet body has an inner wall defining a passage extending therethrough; a mechanism to control liquid flow; and a spray handle having a first end section and a sprayer end section, wherein the first end section is configured to be detachably connected to the faucet body portion, an inner wall defining a passage extending therethrough in open communication with the passage extending through the faucet body, a hose connection configured for receiving a hose for delivering liquid to the spray handle, and a pull-down diverter in liquid communication with the hose connection, wherein the pull-down diverter is in the spray end section of the spray handle, the diverter being capable of providing a first spray mode and a second spray mode.

A faucet is also within the invention that comprises: a faucet body having a first open end configured for connection with a faucet base, a second open end, and a side faucet body portion having a side opening therein, wherein the faucet body has an inner wall defining a passage extending therethrough; a mechanism to control liquid flow through the faucet body; and a spray handle having a first end section and a sprayer end section, wherein the first end section is configured to be detachably connected to the side faucet body portion, an inner wall defining a passage extending therethrough in open communication with the passage extending through the faucet body, a hose connection within the spray end section of the spray handle, wherein the hose connection is configured for receiving a hose extending through the spray handle; and a pull-down diverter in liquid communication with the hose connection, wherein the pull-down diverter is in the spray end section of the spray handle, the diverter being capable of providing a first spray mode and a second spray mode.

The invention further includes a faucet assembly comprising: a faucet having a faucet body comprising a first open end connected to a faucet base, a second open end having a faucet handle movably connected thereto, the faucet handle being capable of controlling the flow of liquid through the faucet, wherein the faucet body further has a faucet body portion with an opening therein and an inner wall defining a passage extending therethrough; a spray handle having a first end section and a sprayer end section, wherein the first end section is configured to be detachably connected to the faucet body portion, an inner wall defining a passage extending therethrough in open communication with the passage extending through the faucet body, a hose connection within the spray end section of the spray handle, wherein the hose connection is configured for receiving a hose extending through the spray handle; a faucet connector having a first portion configured to be engage the inner wall of the first end section of the spray handle and a second portion configured to be within first end section of the spray handle which is configured to be positioned within the faucet body through the opening in the faucet body portion, a pull-down diverter in liquid communication with the hose connection, wherein the pull-down diverter is in the spray end section of the spray handle, the diverter being capable of providing a first spray mode and a second spray mode; and a flexible hose capable of containing a liquid to be delivered through the faucet, wherein the hose extends from a connection end in communication with a liquid source, through the passage in the faucet body and the side opening therein, through the faucet connector, through the passage in the spray handle to the hose connection.

A method of delivering a liquid through a faucet is also within the invention as described herein and comprises: introducing the liquid from a liquid source into a first end of a hose, wherein the hose is situated within: a passage defined by an inner wall of a faucet body and extending through the faucet body, a passage defined by an inner wall of a spray handle and extending through the spray handle, wherein the spray handle has a first end section and a sprayer end section, wherein the first end section is configured to be detachably connected to a faucet body portion of the faucet body, and wherein the passage in the spray handle is in open liquid communication with the passage through the faucet body, and a hose connection within the spray end section of the spray handle, wherein the hose connection is configured for receiving a hose extending through passage in the spray handle; passing the liquid through the hose and out a second end of the hose, then through the hose connection; and passing the liquid through an outlet in the spray end section of the spray handle.

In one embodiment herein, the step of passing the liquid through the outlet in the spray end section of the spray handle further comprises passing the liquid through a pull-down diverter positioned in the spray end section of the spray handle, wherein the liquid exits the diverter as a first spray or a second spray.

BRIEF DESCRIPTION OF THE SEVERAL VIEWS OF THE DRAWING(S)

The foregoing summary, as well as the following detailed description of preferred embodiments of the invention, will be better understood when read in conjunction with the appended drawings. For the purpose of illustrating the invention, there is shown in the drawings embodiments that are presently preferred. It should be understood, however, that the invention is not limited to the precise arrangements and instrumentalities shown. In the drawings.

DETAILED DESCRIPTION OF THE INVENTION

Figure 1:
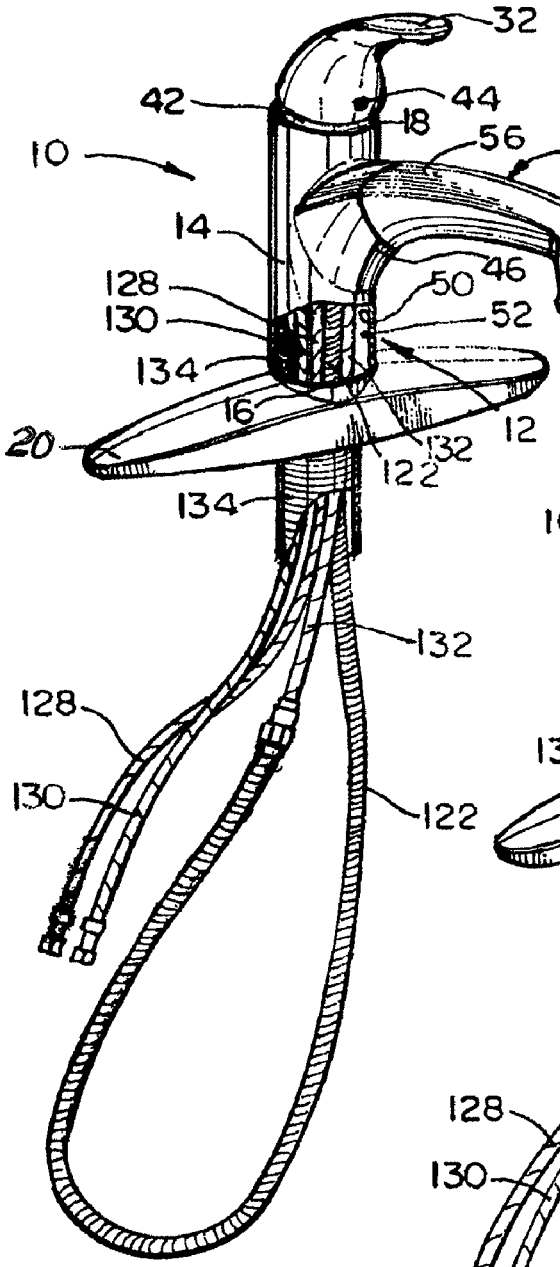
FIG. 1 is a partially broken, perspective view of a faucet assembly having a faucet according to one embodiment of the invention herein.

The invention herein is described with reference to an exemplary preferred embodiment, which is not intended to be limiting. As used herein, the words "right" and "left," "inner" and "outer," "up" and "down," and words of similar import are used for convenience only in describing the invention with reference to directions in the drawings, and are also not intended to be limiting. Described herein are embodiments of a faucet, faucet assembly and method for delivering a liquid through a faucet. In one embodiment, a faucet assembly, generally referred to herein as assembly 10 is shown in perspective view in FIG. 1. The assembly includes a faucet 12 and a flexible outlet hose 122.

The faucet 12 in the embodiment shown has a faucet body 14 which is of a branched configuration. Faucets according to the invention have at least two open ends for receiving a faucet base and/or handle and preferably also have a third opening in a portion of the faucet for receiving a spray handle. The arrangement of the openings can be as shown in the Figures herein or reversed so that the handle is on the bottom and other fixtures like a cap or base is on the top and/or side of the faucet. Further the handle may be located on the side, the base on the bottom and the sprayer on the top. The arrangement shown is a preferred embodiment, however, it should not be taken to be a limiting configuration. The faucet body may be a standard shaped faucet body of a generally tubular, generally cylindrical or branched generally cylindrical configuration as shown, but may have other shapes and cross-sectional configurations as well for decorative or aesthetic changes, such as a generally square, generally rectangular, generally elliptical, outwardly curved spherical or generally triangular cross-sectional shape. Further, the faucet body may be elongated so as to stretch in the longitudinal, upright direction or may be wider than taller so as to extend more broadly in the transverse, horizontal direction.

The faucet body may be formed of metallic material, such as a stainless steel or other metal, having a chrome or other polished finish or may be molded of a polymeric material having a lighter weight. Composite or laminated materials with chromium or other colored or decorative outer layers or coloring may be used as well. Any suitable faucet body material known or to be developed may be used provided that it is preferred that the faucet body have sufficient structural integrity to sustain repeat use, manual operation and secure the integrity of the inner parts of the faucet and resist pressure from the flow of water should an internal piece of hose connection fail.

Figure 2:
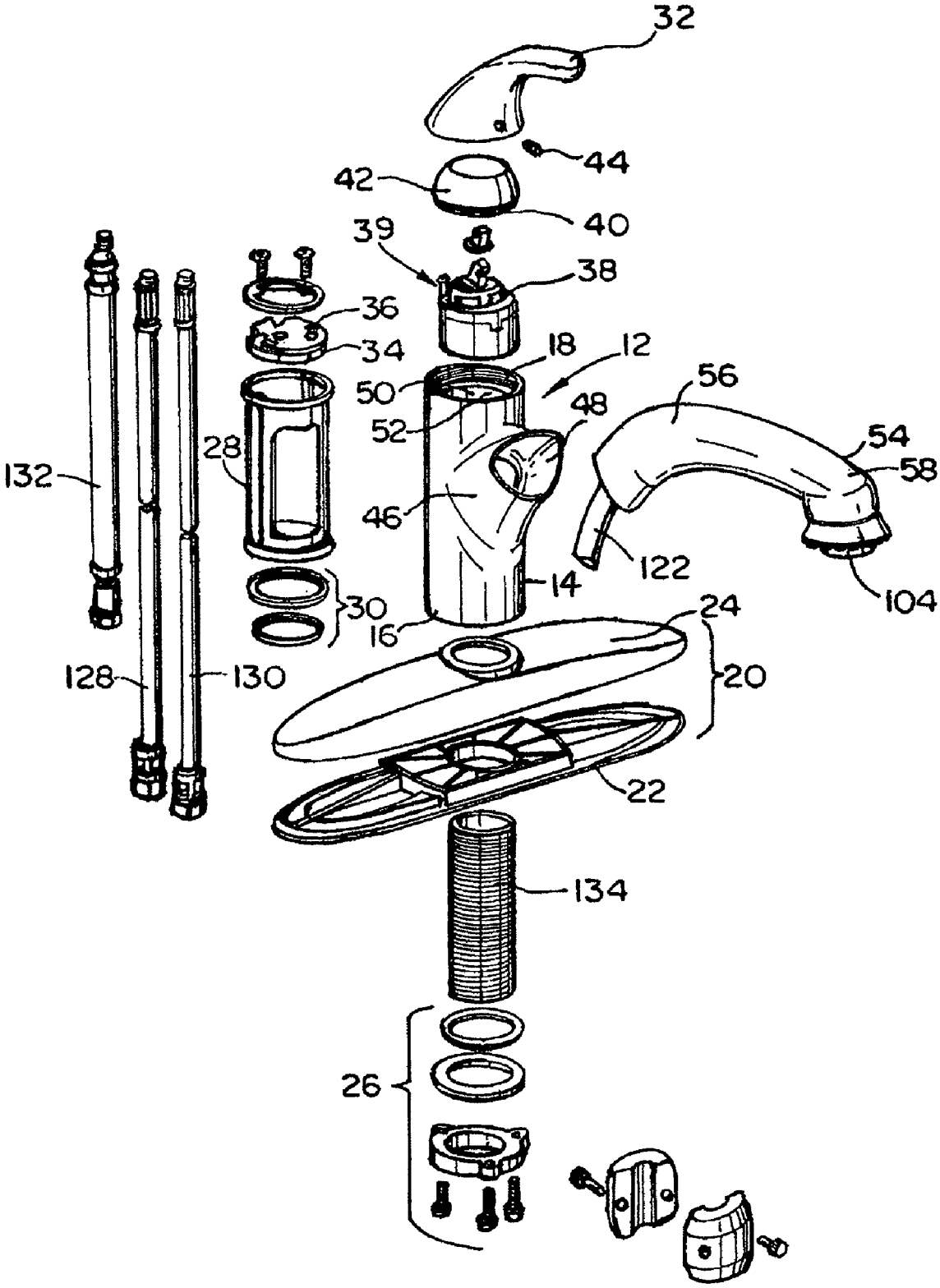
FIG. 2 is a perspective exploded view of the faucet of FIG. 1.

As shown in the embodiment of FIGS. 1 and 2, the faucet body has a first open end 16 at the bottom thereof for connecting to a faucet base, such as exemplary base 20. The faucet body also has a second open end 18 which is configured to receive a faucet handle or other operative flow controlling on, off and flow adjusting mechanism. A side faucet body portion 46 is shown as a branched area of the faucet body 14 configured to connect with a spray handle 54. A side opening 48 is preferably located at the outwardly extending end of the side faucet body portion 46. The inner wall 50 of the faucet body 14 is configured so as to define a passage 52 through the faucet body for allowing liquid to flow upward and downward through the faucet body so as to enable liquid to enter the flexible outlet hose 122 and pass through the hose and the faucet body 14 into the spray handle 54. As shown, liquid flows upward through the faucet body through conduits, such as hot and cold inlet conduits 128 and 130 with mixed liquid flowing downward through conduit 132 which may be connected to flexible outlet hose 122 so as to deliver mixed liquid to the spray handle. Such conduits 128, 130, 132 may be formed of any suitable material for plumbing feed water and outlet water, having sufficient structural integrity to hold liquid pressure for the faucet, including standard household water pressure limits. Stainless steel, reinforced and bendable for flexible conduit, tubing or hose materials (including PVC or other flexible hose) can be used for such conduits as are known in the plumbing arts. For outlet hose 122, a decorative outer flexible covering may be used for aesthetic, tactile and wear purposes.

Figure 1A:
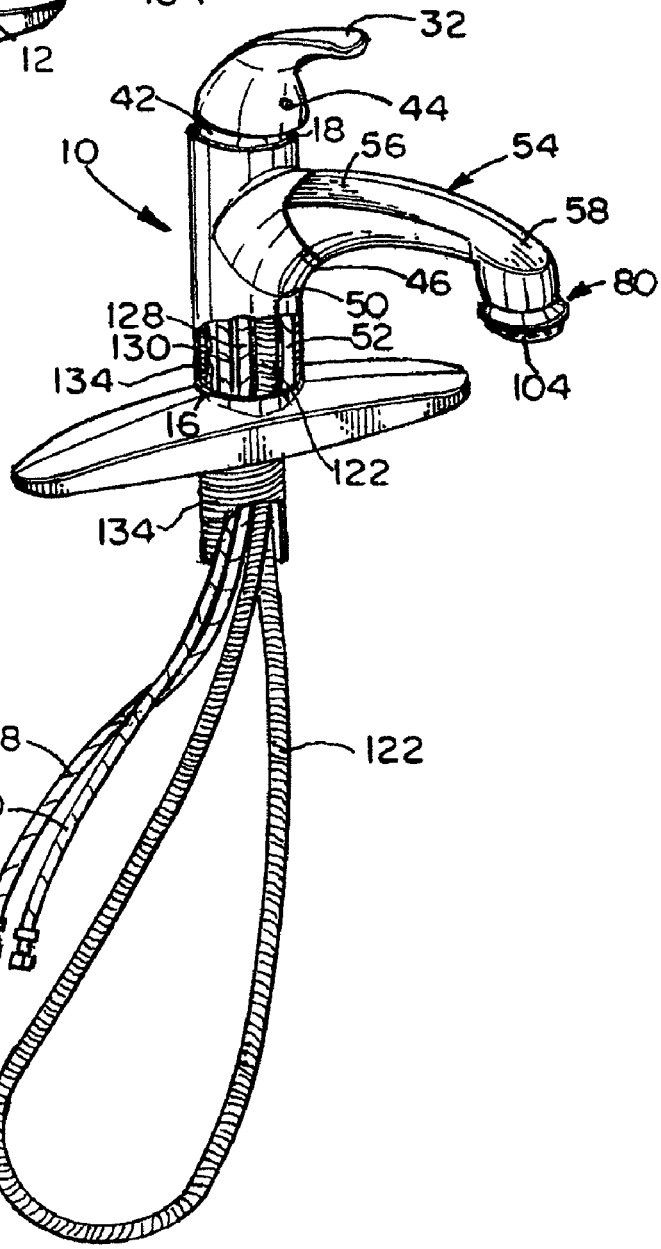
FIG. 1A is an alternative embodiment of the faucet of FIG. 1 in which one end of the flexible hose extends from the mixer to the spray handle.

As shown in FIG. 1A, in an alternative embodiment herein, it is within the scope of the invention, due to the unique design developed herein, that instead of connecting outlet hose 122 to outlet conduit 132, that outlet hose 122 can be extended so as to connect instead to a water inlet source directly and/or to an inlet device such as a hot and cold liquid mixing mechanism. This avoids a joint location and the need for an extra hose connection. Thus, the outlet hose 122 can be a single hose connected directly to a water inlet source, a valve, mixing mechanism, etc. or can be connected to another outlet conduit or hose such as outlet conduit 132.

The faucet body 14 may have any suitable handle located preferably at the top end thereof. Many such types of handles are shown and it should be understood that the location of the handle as shown on the upper end of the faucet body, instead of on a lower opening or side end, is illustrated herein for convenience only and to demonstrate a preferred embodiment. As with the faucet body, the handle may be of varied sizes, shapes and configurations, and made be made of a variety of materials, including chrome, polymers, composites, stainless steel, laminated materials and the like. Various aesthetic features or decorative features may also be added to such a handle without departing from the spirit and scope of this invention. Regardless of whether a handle is used, while preferred for controlling liquid flow, the faucet should have some liquid flow control mechanism. If a handle is not positioned within one of the faucet body openings, the opening may be in communication with another actuator or flow control mechanism, such as a push button, push/pull device, squeeze mechanism or the like. In addition, if a handle is used as a flow control actuating mechanism, it is within the scope of the invention also to include other flow controlling mechanisms, valves, on-off mechanisms and the like, provided there is some mechanism as are known in the art or to be developed, which allows for control of liquid flow through the faucet.

As shown in FIGS. 1 and 2, a handle 32 can be a standard faucet handle, such as those used commonly used in kitchen faucets. The faucet handle 32 sits and can be adjustably attached, such as by a set screw 44 or the like to a handle holding mechanism on which the handle can move to various positions for turning on and off and/or otherwise adjusting the rate of flow of liquid, such as water, through the faucet. In FIG. 2, the handle 32 is adjustably mounted using a handle screw mechanism such as a set screw 44 to a cap 42 which sits so as to surround and be snap-connected to or otherwise attach to a cap retainer 40. The cap retainer 40 is located above and around a mixing mechanism 39.

The mixing mechanism may be any suitable liquid mixing mechanism known in the art or to be developed for similar uses. Preferably it includes several parts including a cartridge 38 having cartridge adjustment screws for adjustably securing the cartridge at least partially within the faucet body 14 and beneath the cap retainer 40 and cap 42. The mixing mechanism also includes a spacer 36 and a manifold assembly 34. The cartridge has openings in the bottom portion thereof to allow for inflow of two liquid streams, such as hot and cold water from hot and cold water sources as well as a flow opening for mixed liquids coming out of the mixing mechanism. The openings preferably include elastomeric or other sealing components. Liquids, such as hot and cold water from hot and cold water sources, can thus flow upward through hot and cold water conduits 128, 130, respectively, through openings in the manifold assembly 34 and into the spacer 36 through corresponding openings and then into the cartridge 38. The mixing mechanism may also include other components as are known or to be developed in the art, such as flow regulating devices (for example check valves to prevent backflow), and can also be fitted with a vacuum breaker if desired.

Mixed temperature water then flows through conduit 132, preferably downwardly, and the outlet conduit is then connected to a flexible hose for allowing water flow to be communicated to the sprayer handle such as through flexible hose 122 as shown in FIG. 1, or as in FIG. 1A, the water may flow directly down from the mixing mechanism into flexible hose 122 without the need for outlet 132. The flexible hose 122 is preferably a reinforced hose, having an internal passageway and/or tubing (elastomeric, metallic or polymeric) which is sufficiently strong to hold the liquid pressure being used in the faucet, preferably standard household water pressure. The hose may be formed of a layered, reinforced material or be standard hose tubing enclosed within a reinforced exterior, such as a flexible metallic outer housing commonly used in kitchen sprayers, laboratory washers and the like. Preferably, the reinforced hose 122 is aesthetically coordinated with the outer design materials of the faucet body and spray handle so as to have a consistent look when pulled out with the spray handle by a user.

Such handles and mixing mechanisms are well known in the art, and any suitable handle and mixing mechanism may be used that currently is developed or may be developed in the future, provided it does not otherwise interfere with the novel features described herein. It is also within the scope of the invention to locate the mixing mechanism outside of the faucet body, for example, beneath the base 20 so as to minimize the amount of hardware used within the faucet body.

The base 20 of the faucet assembly may also be a standard faucet base 20 so that any suitable faucet base may be used including those now in use or to be developed as the nature of the base or material of construction thereof is not critical to the invention herein. The base 20 as shown includes an escutcheon kit 24, which may be putty sealed to the base and a sink or other basin, for example, and a base plate 22 for positioning between the escutcheon 24 and a sink or basin surface. O-rings such as O-rings 30 or other sealing components are preferably used between the base and the faucet body. If the faucet body 14 has an inner protective piece for guiding the internal conduits, such as inner body 28 as shown in FIG. 2, the sealing components may be situated between the base and the inner body. Any suitable mounting kit such as the components in mounting kit 26 to secure the base 20 to a sink or basin.

The flexible hose 122 preferably passes through the entire assembly 10 extending from the sprayer end section 58 of the spray handle 54 through a faucet body portion, such as side faucet body portion 46 of the faucet body 14, down through the passage 52 within the faucet body within the inner body 28, through the base 20 and below the base for connection to an outflow conduit 132.

The faucet 12 herein includes a spray handle 54 which is detachable from the faucet body 14. The spray handle has a first end section 56 and a sprayer end section 58. The first end section 56 is configured to be detachably connected to the side faucet body portion 46 of the faucet body 14. The spray handle 54 has an inner wall 60 that defines a passageway 62 extending through the spray handle. The passage 62 is in open liquid communication with the passage 52 in the faucet body.

One of the benefits of the embodiment of the invention herein wherein the spray handle 54 includes a hose connection as described further herein in the sprayer end section 58 of spray handle 54 is that by virtue of such configuration of the spray handle, the shell material used for making the spray handle and other mechanical components within the sprayer end section 58 of the spray handle need not be especially reinforced to resist open water pressure within the passage of the spray handle 54. In prior art spray handles wherein the hose connection is on the end of the spray handle away from the sprayer end section, a water delivery hose typically does not pass through the spray handle. In such a case, water enters the interior of the spray handle, which must be either reinforced metal and/or formed of other more costly reinforcing materials for an outer shell in a tube-in-tube design. However, the present embodiment spray handle allows for passage of a reinforced water hose such as flexible hose 122 to pass through the passage 62 in the spray handle so that the spray handle shell may be formed of less costly and lighter weight materials.

In one embodiment herein the spray handle shell may be molded of a thermoplastic material, which may be filled or unfilled with reinforcing material. Such materials may include standard heat moldable materials which may include standard or specialty, additives, fillers, fibrous materials and the like as well as colorants (such as pigments or dyes) for varying aesthetic looks and/or may have a laminated, composite construction as well (for example, use of a molded shell having a chromium molded thermoplastic laminate outer coating). In one preferred embodiment, the shell of the spray handle 54 is formed of a thermoplastic such as acrylonitrile-butadiene-styrene (ABS), however, other similar thermoplastics which are sufficiently durable for hand held use and wear, such as polystyrene (PS), polyamides (PA), polycarbonates (PC), polyrurethanes (PU), polyimides (PI), polyetherimides (PEI), polysulfone (PS), polyethersulfone (PES), polyolefins such as polypropylene (PP), polyethylene (PE), and high-density polyethylene (HDPE), and polyoxyalkylenes such as polyoxymethylene (POM) and similar molding materials as well as blends and copolymers of such materials may be used. The shell may be made using any suitable technique, including heat molding, compression molding, vacuum molding, lamination and heat molding and the like.

Figure 3:
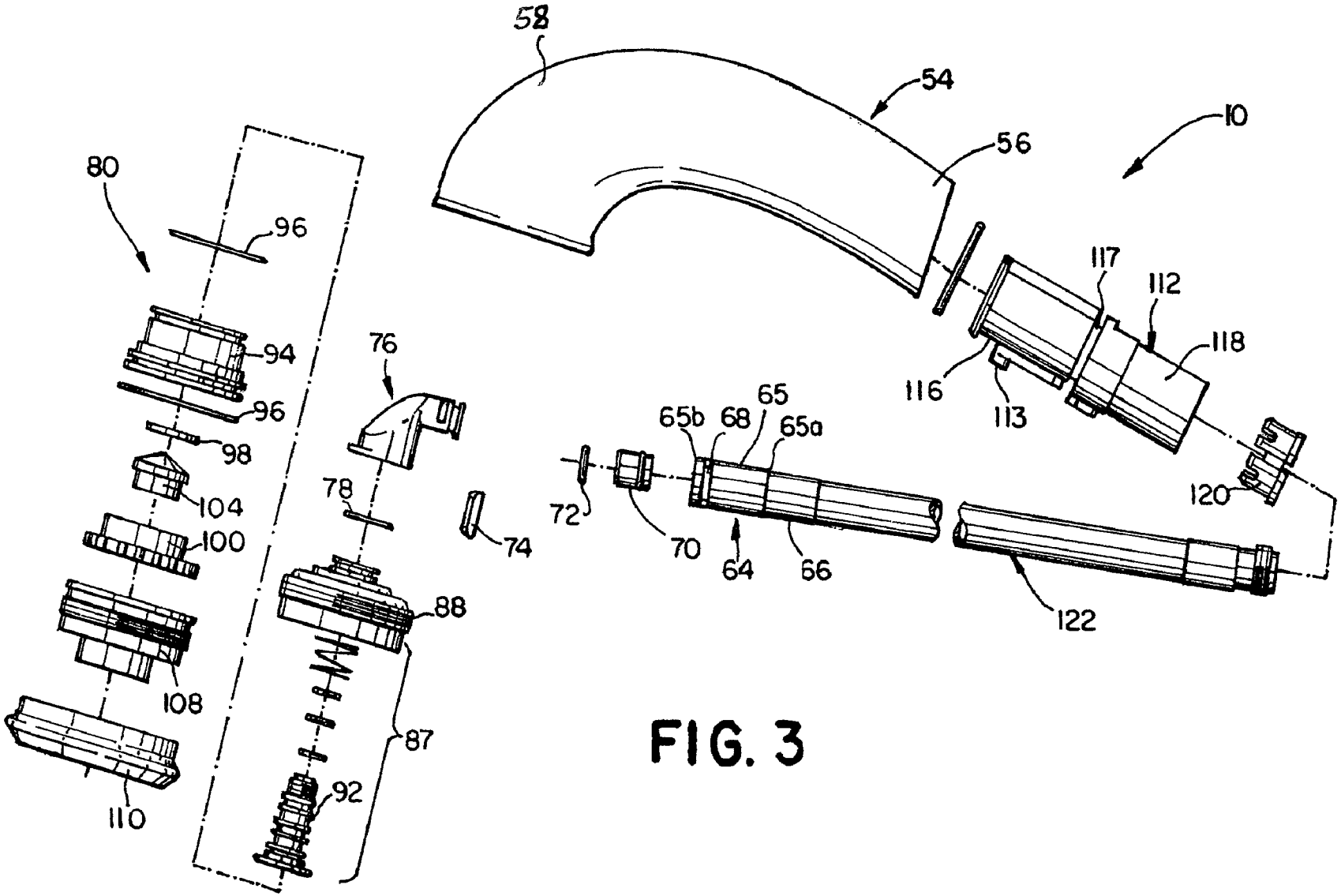
FIG. 3 is a perspective exploded view of only the spray handle portion of the faucet of FIG. 1.
Figure 7:
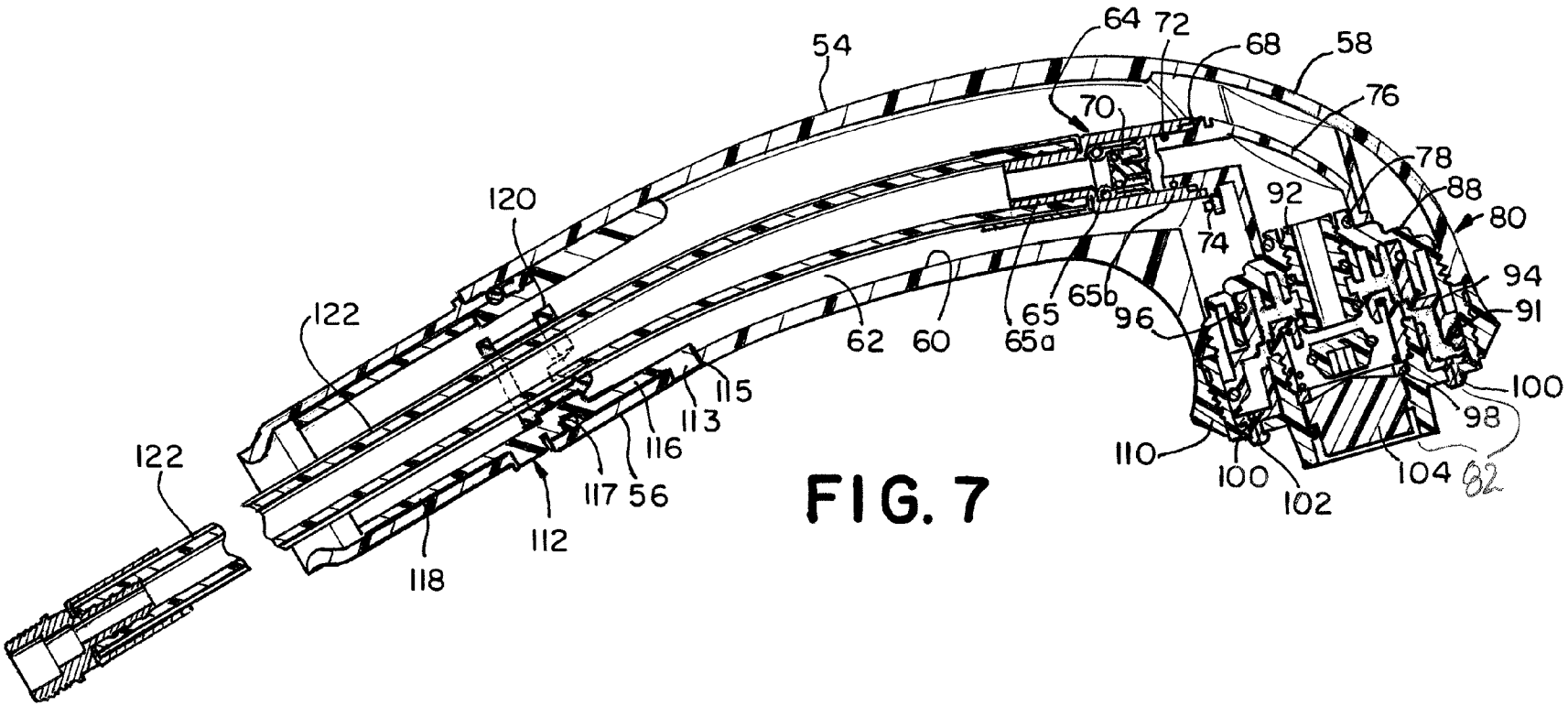
FIG. 7 is a cross-sectional view of the spray handle showing a faucet connector.

The spray handle 54 may be detachably connected to the faucet body using any suitable attachment means which is easily releasable under manual push/pull force, but is sufficiently sturdy so as not to fall out or detach from the faucet body without use of applied manual force. Preferably, a faucet connector is used such as connector 112. The connector has a first portion 116 that is configured to be engaged with the inner wall 60 of the spray handle 54. The first portion 116 may be releaseably engaged to the inner wall 60 or permanently engaged either through friction fit or fused as an integral part (through heat molding techniques or adhesive). The first end section 56 of the spray handle is preferably configured so as to receive the first portion 116 of the faucet connector 112. As shown in more detail in FIGS. 3 and 7, the connector 112 may have a releasable guide piece 113 that fits within a mating opening or slot 115 in the spray handle to keep the connector in place. The connector preferably also has a recessed portion 117 for receiving an o-ring 119 or other seal as shown in FIG. 7. The second portion 118 of the faucet connector 112 is preferably configured to fit within the first end section 56 of the spray handle 54 so that such section of the spray handle having the connector is configured to be received within the faucet body through the side opening 48 in the side faucet body portion 46. The second portion 118 of the faucet connector 112 along with the first end section 56 of the spray handle 54 can thus be slidingly engaged within the side faucet body portion 46 of the faucet. The connector 112 may be formed of polymeric thermoplastic molding materials such as those noted above for the spray handle 54, and preferably is formed of polyoxymethylene.

The faucet further preferably includes an adapter 120 for strain relief, preferably but not necessarily formed of similar polymeric material to that used for forming connector 112. The adaptor helps to maintain the flexible hose 122 in a stable position within the first end section 56 of the spray handle 54 and prevents harm to the diverter portion of the spray handle by providing strain relief. The adaptor is preferably situated so as to be within the first end section 56 of the spray handle within an interior space 114 of the faucet connector 112.

Within the spray handle 54, the faucet preferably includes a hose connection. In one preferred embodiment, as shown in FIGS. 3, 4, 5 and 7, the hose connection 64 is located within the sprayer end section 58 of the spray handle 54. By locating the hose connection in the sprayer end section 58, the faucet allows for the hose 122 to pass through the majority of the sprayer handle 54. Any suitable hose connection may be used herein. In one embodiment, a hose connection 64 can be used which is preferably configured so as to receive a hose extending through the spray handle. In such embodiment, this is arranged by providing a hose connector, such as hose connector 65. The hose may also preferably have an end fitting 66 which contacts the hose connector 65. The first end 65a of the hose connector 65 receives the hose 122. The first end 65a may be provided with a knurled or threaded gripping end so as to fit within and grip the interior surface of the hose and/or a pre-manufactured hose connection such as a stainless steel hose connection crimped to a brass connector. The second end 65b of the hose connector 65 is locked or otherwise connected to waterway 76. In one embodiment, the second end 65b can be configured so as to have an opening, such as a slot or groove 68, shaped to receive a hose stabilizing device such as connection clip (C-clip) 74 or similar device. The clip fits snuggly within the interior passage 62 in the spray handle against the inner wall so that he hose stays stable within the spray handle. The clip may also have a seal, such as an o-ring to seal waterway 76 to hose connector 65 for a tight sealing fit.

Preferably a flow regulator of some kind is also provided within the flow portions of the mechanisms within the sprayer end of the spray handle. In one preferred embodiment, at least one check valve, such as check valve 70 is located within the hose connector 65 before the clip 74 so as to ensure no backflow at the hose connection to prevent dirty water from flowing backwards and to provide positive pressure. While the current embodiment shown, only one such check valve is necessary, other such valves or other flow regulators may be used in various locations within the design without departing from the scope of the invention.

The connection clip 74 and hose connection may also be formed of the same molding materials noted above, and preferably, but not necessarily of the same materials as the connector 112 and adaptor 120. O-rings and other gasketing material used herein may be formed of elastomeric materials, thermoplastic materials, thermoplastic elastomer materials or any suitable leak preventing material for providing a tight seal, but which preferably would not extrude under temperatures encountered in the hose 122 and through the faucet 12. Suitable elastomers for o-rings include ethylene-propylene diene rubber (EPDM), ethylene propylene rubber (EPR), polytetrafluoroethylene (PTFE, commercially available as Teflon®), polyolefinic and other thermoplastic materials, polyurethane rubber, fluoroelastomers (FKM), perfluoroelastomers (FFKM), neoprene, butadiene, styrene-butadiene-styrene rubber (SBS), styrene-ethylene-butadiene-styrene rubber (SEBS) and the like. The check valves or other flow regulators may be any suitable check valve or flow regulator for use in faucets, including check valves commercially available, for example, under the name Neoperl®, of Waterbury, Conn.

The hose connection 64 is preferably in liquid communication with a diverter, such as pull down diverter 80. A preferred connection such as conduit 76 provides a waterway from the hose 122 and hose connection 64 to the diverter 80. The conduit 76 is preferably angled in a way compatible with the design of the outer shell of the spray handle. The conduit is preferably also formed of a molding material as described elsewhere herein, such as preferably, but not necessarily, POM. As shown, the sprayer end 58 of the spray handle 54 is curved downward to direct liquid flow through an outlet 82 of the spray handle in a downward direction in standard faucet seated position and for directional flow when used as a detached spray handle. Thus, the conduit 76 is also preferably curved or angled so as to direct liquid from the hose towards the outlet and diverter. As shown, an extension arm of the conduit can fit within the clip 74 and the end of the hose connector so as to sealingly engage the check valve for a tighter flow. Liquid exiting the other end of the conduit has a larger diameter opening for directing liquid into the diverter 80.

As shown, in one preferred embodiment, the faucet described herein provides a pull down diverter mechanism to the pull-out spray handle, wherein the faucet is also preferably a kitchen faucet. Such pull-down diverters are not believed to be known for adaptation to a kitchen pull-out spray faucet, regardless of whether the faucet has the novel feature mentioned above and shown in the drawings herein concerning placement of a hose connection in the sprayer end of a pull-out spray head. Both of these features, use of a pull-down diverter in a pull-out sprayer, particularly in a kitchen faucet having a pull-out spray handle, and use of a hose connection in a pull-out spray handle that is located in the sprayer end of the spray handle are significant improvements in the various embodiments of the invention. Thus, it is within the scope of the invention to use a pull-down diverter in a kitchen faucet regardless of the location of the hose connection (i.e., whether it is located at the sprayer end of a spray handle according to a preferred novel embodiment herein or located at the opposite end of the spray handle as in prior art combination sprayers). It is also within the scope of the invention to use another sprayer diversion mechanism (aside from the pull-down diverter shown in the preferred embodiment herein) with the novel feature of locating the hose connection in the sprayer end of the spray handle as shown in the drawings. It is preferred to use each of these features together, but one skilled in the art will appreciate that either novel feature may be used alone without departing from the spirit and scope of the invention.

In the preferred embodiment shown, the pull-down diverter 80 can have varying configurations (see FIGS. 3 and 7) and preferably has a spring-actuated adjuster mechanism 87, wherein the size and spacing of the adjusters for adjusting the mechanism up or down for switching between at least two spray modes, such as a first spray mode and a second spray mode. In one embodiment, flow may be diverted from a first spray mode which is an aerated direct flow to a second spray mode in which more of a spray flow is used and the spray modes and types of sprays may be varied. As shown with reference to FIG. 3, an upward adjuster piece 88 sits in sealing engagement, such as by o-ring 78, with the outlet facing end of the conduit 76. The upward adjuster piece 88 receives a spring actuated plunger 92 having spring 90 positioned so as to extend around the outer surface of the plunger 92. The opposite end of the plunger from the upward adjuster piece 88 sits within a downward adjuster piece 94 which is sealingly engaged, such as through o-ring 96, with the spray features of the diverter. The plunger 92, upward adjuster piece 88 and downward adjuster piece 94 are all preferably formed of a molding material preferably, but necessarily, similar to the material used to form the conduit 76, connector 112 and adaptor 120, for example, POM. The various washers and o-rings may be formed of the same or different materials from those used to form the o-rings noted above, and are preferably EPDM or a similar material.

The aerator 104 sits within the central portion of the downward adjuster piece 94, preferably having a washer 98 situated around the top of the aerator within the downward adjuster piece 94, and also within the central axially extending hole in a ring-shaped elastomeric nozzle for spray delivery 100. The aerator may be any suitable aerator useful for providing an aerated direct liquid flow from a faucet. Such aerators are commercially available as Neoperl®. The nozzle 100 sits within a face plate 108 which may optionally also have a decorative ring 110 or other design piece for downward pulling of the diverter. The nozzle 100 is preferably formed of a material with structural integrity, good thermal properties and flexibility. While any of the thermoplastic or elastomer materials noted above are suitable, preferably a thermoplastic olefin elastomer is used, for example Santoprene®, commercially available from ExxonMobil or a similar material. The faceplate should be somewhat more resistant to pressure so as to hold the spray nozzle spraying functional features in place. While any suitable material for other parts and/or components of the spray handle noted herein may be used to form the faceplate 108, it is preferred that a reinforced and/or composite material is used to provide good structural integrity, such as a composite of glass-fiber reinforced polypropylene (having 20% by volume glass fiber). The decorative ring should be formed of a any of the materials noted herein, but is preferably formed of a moldable thermoplastic or elastomeric material similar to that of the faucet body so as to withstand manual wear and use as well as cleaning materials, preferably ABS or a similar polymeric material.

Figure 6A:
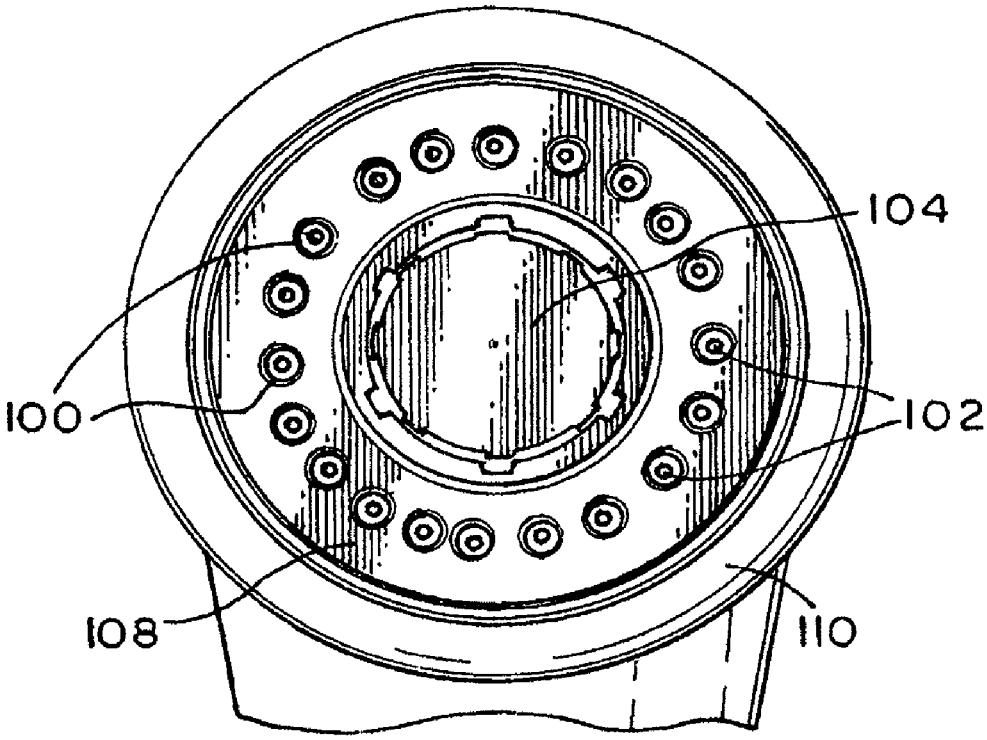
FIG. 6A is a bottom plan view of the outlet of the sprayer end section of the spray handle of the faucet of FIG. 1.
Figure 6B:
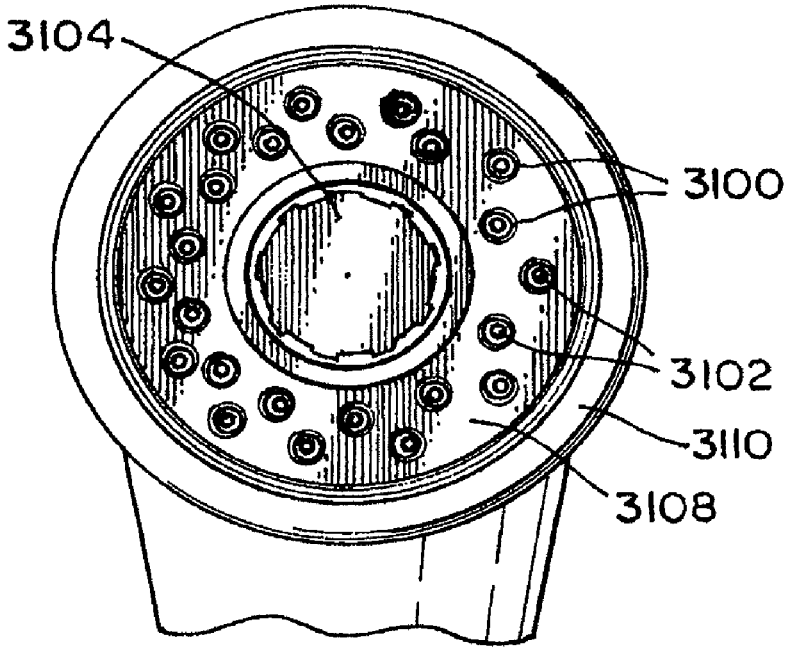
FIG. 6B is an alternative embodiment of FIG. 6A.

The spray holes 102 extending transversely through the nozzle 100 may be circularly aligned around the centrally located aerator as shown in the preferred embodiment in FIG. 6A or staggered as shown in FIG. 6B to provide a different spray effect. In FIG. 6B, holes 3102 are staggered around aerator portion 3104. The preferred design in FIG. 6A provides better flow space and pressure within the sprayer end of the spray handle and so is preferred, however, other configurations are within the scope of the invention.

Figure 4:
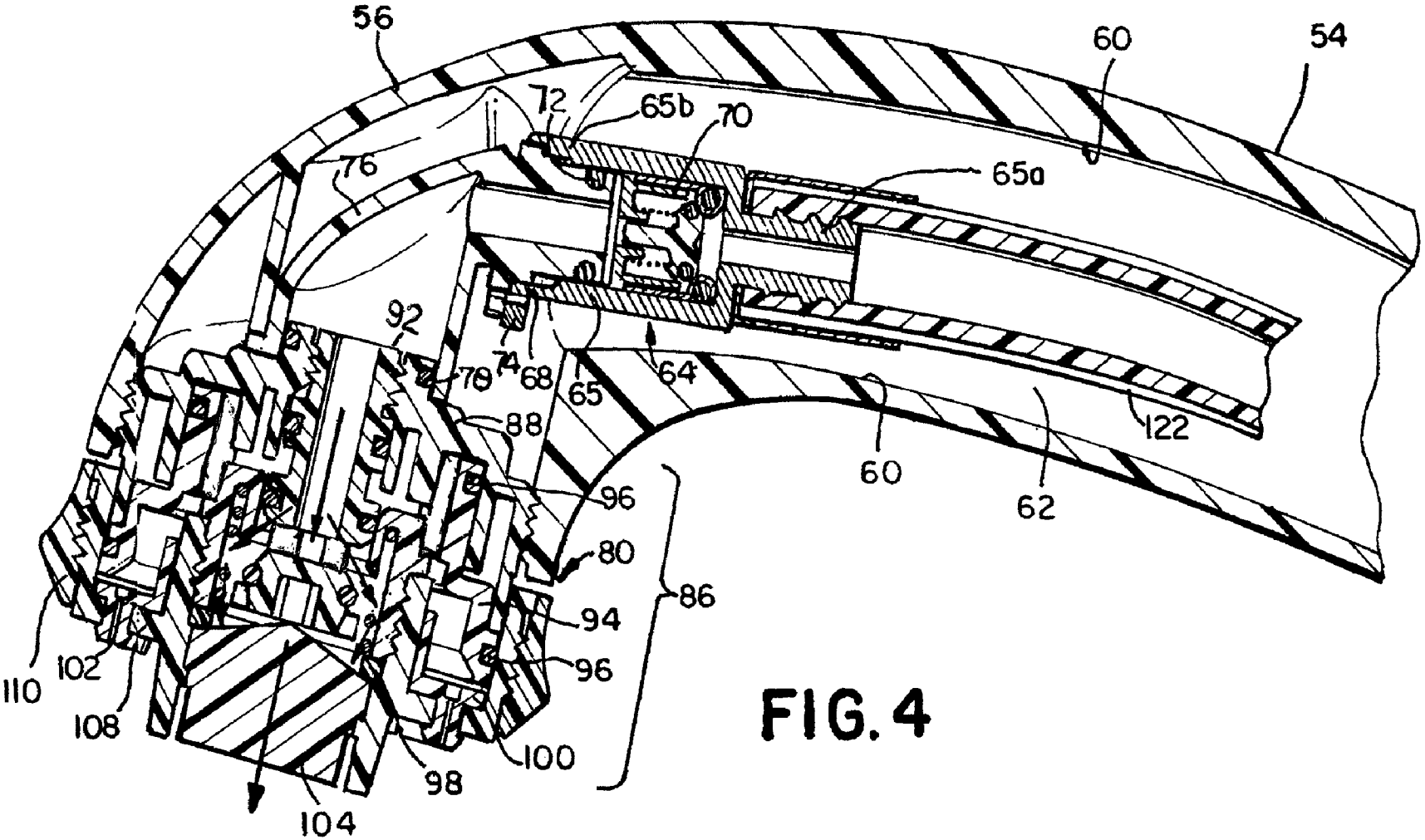
FIG. 4 is a longitudinal cross-sectional view of a portion of the sprayer end section of the spray handle of FIG. 1 showing flow directional arrows for aerated flow.
Figure 5:
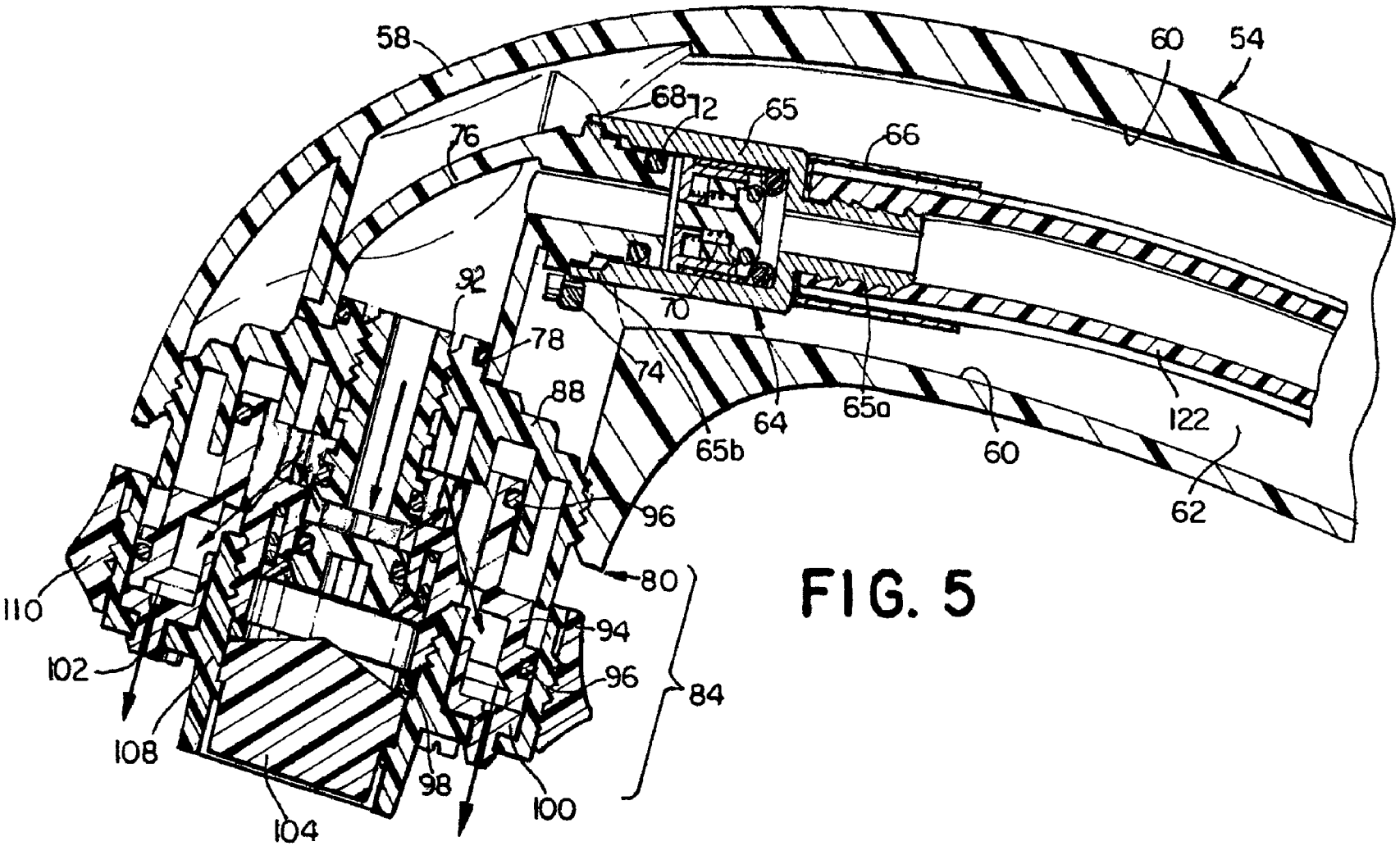
FIG. 5 is a cross-sectional view of the portion of the sprayer end section of the spray handle of FIGS. 1 and 4 showing flow directional arrows for spray flow.

As shown in FIGS. 4 and 5, the flow in a non-actuated aerator position 86, liquid flows through a central opening in the plunger 92, which has screw threads for mating threads within the upward adjuster piece. Because the diverter is in the upward position, flow channels to the spray nozzle holes 102 are foreclosed and liquid must flow through a passage within the downward adjuster piece into the aerator 104 and out the spray handle outlet. In the downward, actuated position for spraying 84, the downward movement of the adjuster piece 94 creates flow openings within the diverter so that liquid flows through the openings into the holes 102 in the spray nozzle. This is one example only and other variations in diverter design may be accommodated provided that adequate flow pressure is maintained.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A faucet comprising, a faucet body having a first opening configured for connection with a faucet base, a second opening, and a faucet body portion having an opening therein, wherein the faucet body has an inner wall defining a passage extending therethrough;

a mechanism to control liquid flow through the faucet body; and a spray handle having a shell and comprising a first end section and a sprayer end section, the spray handle comprising an outlet within the shell in the sprayer end of the handle for liquid flow from the faucet, wherein the first end section is configured to be detachably connected to the faucet body portion, the shell of the spray handle having an inner wall defining a passage extending therethrough in open communication with the passage extending through the faucet body and the shell extending from the first end section to the sprayer end section of the spray handle, and a hose connection is positioned within the sprayer end section of the spray handle, the hose connection being configured for receiving a hose extending through the spray handle, wherein the hose extends within the passageway of the shell through the first end section of the spray handle within the shell and into the sprayer end section of the spray handle, and the hose connection is situated within the shell such that fluid leaving the hose is introduced directly into a water way in communication with the outlet of the spray handle.

2. The faucet according to claim 1, wherein the faucet is a kitchen faucet.

3. The faucet according to claim 1, wherein the faucet further comprises a hot and cold liquid mixing mechanism.

4. The faucet according to claim 1, wherein the faucet body portion is a side faucet body portion.

5. The faucet according to claim 1, wherein the mechanism to control liquid flow is a handle and the handle is positioned in communication with the second opening in the faucet body.

6. The faucet according to claim 1, wherein the spray handle further comprises a pull-down diverter in liquid communication with the hose connection in the sprayer end section of the spray handle, the diverter being capable of providing a first spray mode and a second spray mode.

7. The faucet according to claim 6, wherein the first spray mode provides a spray upon actuation by pulling the diverter to a first actuated position and the second spray mode provides a standard water spray when the diverter is in a non-actuated position.

8. The faucet according to claim 6, wherein the spray handle, the hose connection and the pull down diverter all comprise a polymeric material.

9. The faucet according to claim 6, wherein the pull-down diverter comprises an elastomeric nozzle for delivering a liquid spray.

10. The faucet according to claim 6, wherein the hose connection further comprises a hose connector having a first end configured to be connected to a hose and a second end having an opening therein configured to receive a connection clip for securing the hose connector to a conduit for directing liquid flow from the hose connector towards the diverter.

11. The faucet according to claim 10, wherein the conduit is angled to direct liquid flow from within the first end section of the spray handle to the diverter.

12. The faucet according to claim 6, wherein the diverter comprises a spring-actuated adjuster mechanism, an aerator, a nozzle having spray holes extending transversely therethrough, and a faceplate.

13. The faucet according to claim 1, wherein the sprayer end section of the spray handle further comprises a check valve situated in the hose connector.

14. The faucet according to claim 1, wherein the first end section of the spray handle is configured to receive a first portion of a faucet connector in engagement with the inner wall of the first end section of the spray handle, wherein a second portion of the faucet connector is configured to be positioned within the first end of the spray handle which is configured to be received within the faucet body through the opening in the faucet body portion therein, and the faucet further comprises an adapter for maintaining a hose in a stable position within the first end section of the spray handle, wherein the adapter is situated within an interior space of the faucet connector.

15. The faucet according to claim 14, wherein the first end section of the spray handle is configured to receive the first portion of the faucet connector in releasable engagement with the inner wall of the first end section of the spray handle.

16. A faucet comprising, a faucet body having a first open end configured for connection with a faucet base, a second open end, and a faucet body portion having an opening therein, wherein the faucet body has an inner wall defining a passage extending therethrough;

a mechanism to control liquid flow; and a spray handle having a shell and having a first end section and a sprayer end section, wherein the first end section is configured to be detachably connected to the faucet body portion, the shell of the spray handle having an inner wall defining a passage extending therethrough in open communication with the passage extending through the faucet body, a hose connection configured for receiving a hose for delivering liquid to the spray handle situated within the shell in the sprayer end section of the spray handle, and a pull-down diverter in liquid communication with the hose connection, wherein the pull-down diverter is in the spray end section of the spray handle within the shell, the diverter being capable of providing a first spray mode and a second spray mode.

17. The faucet according to claim 16, wherein the faucet is a kitchen faucet.

18. The faucet according to claim 16, wherein the hose connection is within the sprayer end section of the spray handle and is configured for receiving a hose extending through the spray handle.

19. The faucet according to claim 16, wherein the spray handle, the hose connection and the pull down diverter all comprise a polymeric material.

20. The faucet according to claim 16, wherein the pull-down diverter comprises an elastomeric nozzle for delivering a liquid spray.

21. The faucet according to claim 16, wherein the hose connection further comprises a hose connector having a first end configured to be connected to a hose and a second end having an opening therein configured to receive a connection clip for securing the hose connector to a conduit for directing liquid flow from the hose connector toward the diverter.

22. The faucet according to claim 21, wherein the conduit is angled to direct liquid flow from within the first end section of the spray handle to the diverter.

23. The faucet according to claim 16, wherein the diverter comprises a spring-actuated adjuster mechanism, an aerator, a nozzle having spray holes extending transversely therethrough, and a faceplate.

24. The faucet according to claim 16, wherein the sprayer end section of the spray handle further comprises a check valve situated in the hose connector.

25. The faucet according to claim 16, wherein the first spray mode provides a spray upon actuation by pulling the diverter to a first actuated position and the second spray mode provides a standard water spray when the diverter is in a non-actuated position.

26. The faucet according to claim 16, wherein the first end section of the spray handle is configured to receive a first portion of a faucet connector in engagement with the inner wall of the first end section of the spray handle, wherein a second portion of the faucet connector is configured to be positioned within the first end of the spray handle which is configured to be received within the faucet body through the opening in the faucet body portion, and the faucet further comprises an adapter for maintaining a hose in a stable position within the first end section of the spray handle, wherein the adapter is situated within an interior space of the faucet connector.

27. A faucet comprising, a faucet body having a first open end configured for connection with a faucet base, a second open end, and a side faucet body portion having a side opening therein, wherein the faucet body has an inner wall defining a passage extending therethrough;

a mechanism to control liquid flow through the faucet body; and a spray handle having a shell and comprising a first end section and a sprayer end section, wherein the first end section is configured to be detachably connected to the side faucet body portion, the shell having an inner wall defining a passage extending therethrough in open communication with the passage extending through the faucet body, a hose connection within the sprayer end section of the spray handle, wherein the hose connection is configured for receiving a hose extending through the spray handle; and a pull-down diverter in liquid communication with the hose connection, wherein the pull-down diverter is in the sprayer end section of the spray handle within the shell, the diverter being capable of providing a first spray mode and a second spray mode.

28. The faucet according to claim 27, wherein the faucet is a kitchen faucet.

29. The faucet according to claim 27, wherein the first spray mode provides a spray upon actuation by pulling the diverter to a first actuated position and the second spray mode provides a standard water spray when the diverter is in a non-actuated position.

30. A faucet assembly comprising, a faucet having a faucet body comprising a first open end connected to a faucet base, a second open end having a faucet handle movably connected thereto, the faucet handle being capable of controlling the flow of liquid through the faucet, wherein the faucet body further has a faucet body portion with an opening therein and an inner wall defining a passage extending therethrough;

a spray handle having a shell and comprising a first end section and a sprayer end section, wherein the first end section is configured to be detachably connected to the faucet body portion, the shell having an inner wall defining a passage extending therethrough in open communication with the passage extending through the faucet body, a hose connection within the sprayer end section of the spray handle and within the shell, wherein the hose connection is configured for receiving a hose extending through the spray handle;

a faucet connector having a first portion configured to engage with the inner wall of the first end section of the spray handle and a second portion configured to be within first end section of the spray handle which is configured to be positioned within the faucet body through the opening in the faucet body portion, a pull-down diverter in liquid communication with the hose connection, wherein the pull-down diverter is in the sprayer end section of the spray handle and within the shell, the diverter being capable of providing a first spray mode and a second spray mode; and a flexible hose capable of containing a liquid to be delivered through the faucet, wherein the hose extends from a connection end in communication with a liquid source, through the passage in the faucet body and the opening in the faucet body portion, through the faucet connector, through the passage in the shell of the spray handle to a second end for attachment to the hose connection within the sprayer end section and within the shell.

31. The faucet assembly according to claim 30, wherein the faucet is a kitchen faucet.

32. The faucet assembly according to claim 30, wherein the first spray mode provides a spray upon actuation by pulling the diverter to a first actuated position and the second spray mode provides a standard water spray when the diverter is in a non-actuated position.

33. The faucet assembly according to claim 30, wherein the connection end of the hose connects directly to a mixer as a mixer outlet hose.

34. A method of delivering a liquid through a faucet, comprising introducing the liquid from a liquid source into a first end of a hose, wherein the hose is situated within:

a passage defined by an inner wall of a faucet body and extending through the faucet body, a passage defined by an inner wall of a shell of a spray handle and extending through the shell of the spray handle, wherein the spray handle has a first end section and a sprayer end section, the sprayer end section having an outlet within the shell for liquid flow from the faucet, wherein the first end section is configured to be detachably connected to a faucet body portion of the faucet body, and wherein the passage in the shell of the spray handle is in open liquid communication with the passage through the faucet body, and a hose connection within the shell and the sprayer end section of the spray handle, wherein the hose connection is configured for receiving a hose extending through passage in the spray handle;

passing the liquid through the hose and out a second end of the hose, then through the hose connection; and passing the liquid through the outlet in the spray end section of the spray handle.

35. The method according to claim 34, wherein the step of passing the liquid through the outlet in the spray end section of the spray handle further comprises passing the liquid through a pull-down diverter positioned in the spray end section of the spray handle, wherein the liquid exits the diverter in a first spray mode or a second spray mode.

36. The method according to claim 35, wherein the method delivers liquid through a kitchen faucet.

37. The method according to claim 34, wherein the method delivers liquid through a kitchen faucet.

* * * * *